United States Patent [19]

Schor

[11] 4,037,275

[45] July 26, 1977

[54] SPORTSMAN'S SCREWDRIVER AND WRENCH

[76] Inventor: Fred O. Schor, Rte. 4, Box 367, Harrison, Ark. 72601

[21] Appl. No.: 717,122

[22] Filed: Aug. 24, 1976

[51] Int. Cl.[2] ..... B25F 1/00

[52] U.S. Cl. ..... 7/1 G; 7/1 H

[58] Field of Search ..... 7/1 F, 1 G, 1 H; 81/119, 121 R

[56] References Cited

U.S. PATENT DOCUMENTS 3,803,650 4/1974 D'Amico ..... 7/1 H X

FOREIGN PATENT DOCUMENTS 371,908 4/1932 United Kingdom ..... 7/1 G

*Primary Examiner*—Al Lawrence Smith
*Assistant Examiner*—James G. Smith

[57] ABSTRACT

A tool device comprising in combination an outer tool member including a plurality of radially extending screw driver heads, with an inner tool member including a plurality of wrench apertures, and coupling means for releasably securing the inner tool member to the outer tool member in a substantially horizontal plane.

3 Claims, 4 Drawing Figures

SPORTSMAN'S SCREWDRIVER AND WRENCH

BACKGROUND OF THE INVENTION

The present invention relates to a tool device for multiple-uses and more particularly for use by sportsmen.

There has long been a need for a compact tool that may be used as a screw driver or a wrench that would be ideally suited for use by a sportsman either at home or in the field in order to maintain his equipment. The equipment may be a fishing reel, gun, etc. In addition, a novel kit has been disclosed to further assist the sportsman in the proper maintenance of his equipment. In particular sportsmen's equipment requires very small screw drivers for the fine screws associated therewith and this has been a particular problem, especially in the field when an adjustment has to be made.

OBJECTS OF THE INVENTION

An object of the present invention is to provide a tool which overcomes one or more of the preceding difficulties and/or problems.

Another object of the present invention is to provide a tool designed to perform a multiplicity of functions.

Another object of the present invention is to provide a kit that includes the novel multiple-use tool.

Other objects and advantages of the present invention will become apparent as the disclosure proceeds.

SUMMARY OF THE INVENTION

A tool device comprising in combination an outer tool member including a plurality of radially extending screw driver heads, with an inner tool member including a plurality of wrench apertures, and coupling means for releasably securing the inner tool member to the outer tool member in a substantially horizontal plane.

The outer tool member includes a body portion having an outer peripheral edge and an inner spaced apart edge defining an opening in the body portion, and the screw driver heads extend outwardly from the outer peripheral edge and are integrally formed therewith. Each screw driver head differs as to length or width thereof. The inner tool member includes a plate having an outer peripheral wall in matching conformity to the opening and the wrench apertures extend through the plate and vary in size.

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying drawings forming a part hereof, wherein like referenced numerals refer to like parts throughout the several views and in which:

DETAILED DESCRIPTION OF THE DRAWINGS

Figure 1:
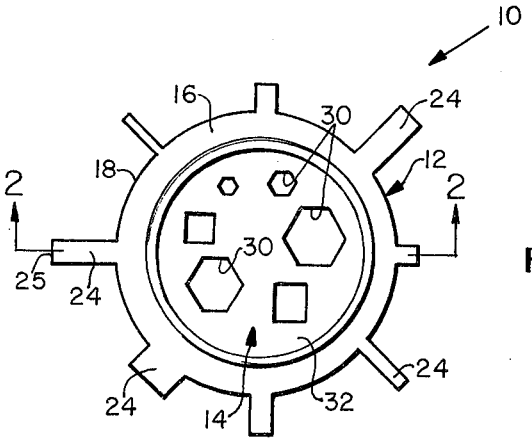
FIG. 1 is a top plan view of the tool device in accordance with the present invention.
Figure 2:
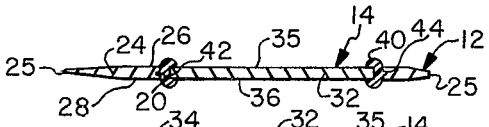
FIG. 2 illustrates a cross-sectional view taken along lines 2—2 of FIG. 1.
Figure 3:
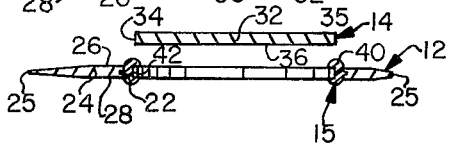
FIG. 3 is a view similar to FIG. 2 with the inner tool member removed from the tool device.

Referring now to the drawings, and initially to FIGS. 1-3 thereof, there is illustrated a tool device 10 that includes in combination an outer tool member 12, an inner tool member 14 and coupling means 15 for releasably securing the inner tool member 14 to the outer tool member 12 in a substantially horizontal plane.

The outer tool member 12 includes a body portion 16 having an outer peripheral edge 18 and an inner spaced apart edge 20 defining an opening 22 in the body portion 16. A plurality of radially extending screw driver heads 24, eight being illustrated, extend outwardly from the outer peripheral edge 18 and integrally formed therewith. Each screw driver head 24 includes a tapered tip or free end for use in conjunction with the various screws which the tool device 10 will be used with. Each screw driver head 24 will differ as to the length or the width thereof and may include Phillips-type heads as well. In this manner the user of the screw drivers will have at his disposal a proper selection for use with various size screws.

The outer tool member 16 includes a spaced apart first surface 26 and second surface 28 which are adapted to have positioned thereon the fingers of the user of the device to obtain the necessary leverage in order to turn the screws. The body portion 16 may be made from a high strength steel material and may be chromium plated. The outer tool member 12 is of a size that may readily form part of a sportsman's kit with the tool device 10 adapted to fit within a tool box, tackle box, etc. In particular, the tool device 10 may be used by a fisherman to tighten screws on a fishing reel, etc. The outer peripheral edge 18 may have a circular configuration as illustrated in FIG. 1.

The inner tool member 14 includes a plurality of wrench apertures 30, six being illustrated, that extend through a plate 32 having an outer peripheral wall 34 as illustrated in FIG. 3. The plate 32 includes a pair of spaced apart surfaces 35 and 36 extending in a substantially horizontal plane. The outer peripheral wall 34 is in matching conformity to the opening 22 and the wrench apertures 30 vary in size and extend through the plate 32 between the surfaces 35 and 36 in order to receive bolt heads of various sizes. The individual wrench apertures 30 may be hexagonal or rectangular in shape. In order to provide greater flexibility to the user, more than one outer tool member 12 or inner tool member 14 may be provided to permit application of the tool device to a greater variety of either screws, bolt heads, or nuts. The plate 32 may be made out of steel and chrome plated or some other metallic material.

The coupling means 15 permits the interchangeability of the inner tool member 14 relative to the outer tool member 12. The coupling means 15 includes a peripherally extending gasket 40 mounted in fixed relationship, but releasably secured to the inner tool member 14. Gasket 40 includes an inner peripherally extending groove 42 adapted to receive therein the outer peripheral wall 34 of the plate 32. A snap-fit between the two is obtained with the surfaces 35 and 36 snugly fitting within the groove 42. The gasket 40 is mounted in fixed relationship to the body portion 16 and may include a bead 44 adapted to be received within the inner edge 20. In the assembled relationship of the outer tool 12 and inner tool 14 the tool device is adapted to be used for various purposes.

Figure 4:
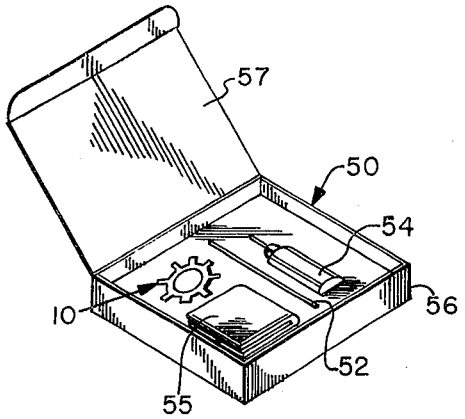
FIG. 4 is a tool kit in accordance with the present invention.

The tool device 10 may form part of a tool kit 50 adapted for use by a sportsman or other user and as illustrated in FIG. 4 the kit may include the tool device 10, a file 52, a container of oil 54, polishing or other cloth 55, supplied in a carton 56 having a cover 57. The tool kit 50 permits the user to maintain whatever equipment the kit is supplied with since a variety of screws and nuts may be tightened or loosened therewith.

Although an illustrative embodiment of the invention has been described in detail herein with reference to the accompanying drawings, it is to be understood that the invention is not limited to the precise embodiment and that various changes and modifications may be effected therein without departing from the scope or spirit of the invention.

I claim:

1. A tool device comprising in combination, a. an outer tool member including a plurality of radially extending screw driver heads, b. said outer tool member includes:

1. a body portion having an outer peripheral edge and an inner spaced apart edge defining an opening in said body portion,
2. said screw driver heads extend outwardly from said outer peripheral edge and are integrally formed therewith, and
3. said plurality of screw driver heads differ as to length or width thereof, c. an inner tool member including a plurality of wrench apertures, d. said inner tool member includes a plate having an outer peripheral wall in matching conformity to said opening in said body portion, and said wrench apertures extend through said plate and vary in size, e. coupling means for releasably securing said inner tool member to said outer tool member in a substantially horizontal plane, such that either of said tool members may be utilized individually or in assembled relation with each other, f. said coupling means includes:

4. a peripherally extending gasket mounted in fixed relationship to said outer tool, and 5. a peripherally extending groove in said gasket adapted to receive therein said inner tool member.

2. A tool device as defined in claim 1, wherein said gasket includes a bead adapted to be received within said outer tool member.

3. A tool kit comprising, a tool device including:

1. an outer tool member including a plurality of radially extending screw driver heads,
2. an inner tool member including a plurality of wrench apertures, adapted to be interchangeable with said outer tool member, and
3. coupling means for releasably securing said inner tool member to said outer tool member in a substantially horizontal plane such that either of said tool members may be utilized individually or in assembled relation with each other, b. said outer tool member includes:

i. a body portion having an outer peripheral edge and an inner spaced apart edge defining an opening in said body portion, ii. said screw driver heads extend outwardly from said outer peripheral edge and integrally formed therewith, and iii. said plurality of screw driver heads each differ as to length or width thereof, c. said inner tool member includes:

iv. a plate having an outer peripheral wall in matching conformity to said opening, and v. said wrench apertures extend through said plate and vary in size, d. said coupling means includes:

vi. a peripherally extending gasket mounted in fixed relationship to said opening, and vii. a peripherally extending groove in said gasket adapted to receive therein said outer peripheral wall of said inner tool member, e. a file, f. a container of oil, and g. a cloth.

* * * * *